US006919844B1

(12) United States Patent
Ryken, Jr. et al.

(10) Patent No.: US 6,919,844 B1
(45) Date of Patent: Jul. 19, 2005

(54) REDUCED SIZE GPS MICROSTRIP ANTENNA WITH A SLOT

(75) Inventors: Marvin L. Ryken, Jr., Oxnard, CA (US); Albert Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/768,748

(22) Filed: Jan. 20, 2004

(51) Int. Cl.[7] ..... H01Q 1/38
(52) U.S. Cl. ..... 343/700 MS; 343/705
(58) Field of Search ..... 343/700 MS, 705, 343/708, 829, 846

(56) References Cited

U.S. PATENT DOCUMENTS

| | | | | | |
|---|---|---|---|---|---|
| 5,241,321 | A | * | 8/1993 | Tsao | 343/700 MS |
| 5,241,322 | A | * | 8/1993 | Gegan | 343/700 MS |
| 5,394,159 | A | * | 2/1995 | Schneider et al. | 343/700 MS |
| 5,400,041 | A | * | 3/1995 | Strickland | 343/700 MS |
| 5,438,697 | A | * | 8/1995 | Fowler et al. | 455/347 |

* cited by examiner

*Primary Examiner*—Tho Phan
(74) *Attorney, Agent, or Firm*—David S. Kalmbaugh

(57) ABSTRACT

A reduced size GPS microstrip antenna which has an annular slot, receives GPS data from an external source and which is adapted for use in a small area on a weapons system such as a missile. The microstrip antenna is square shaped with angled notches at opposite corners of the antenna.

20 Claims, 1 Drawing Sheet

REDUCED SIZE GPS MICROSTRIP ANTENNA WITH A SLOT

BACKGROUND OF THE INVENTION

1. Field of the Invention

The present invention relates generally to a microstrip antenna for use on a weapons system to receive GPS data from an external source. More specifically, the present invention relates to a reduced size GPS microstrip antenna which has a slot, receives GPS data from an external source and which is adapted for use in a small area on a weapons system such as a missile.

2. Description of the Prior Art

Microstrip antennas are currently be used by weapons system, such as missiles, to receive GPS (Global Positioning System) data from external sources such as satellites. This GPS data is transmitted via an RF carrier signal from the satellites to the weapons system.

Microstrip antennas typically operate by resonating at a selected frequency. The design of such antennas normally makes use of printed circuit board techniques which includes a dielectric substrate which has a printed copper patch mounted on its top surface and a copper ground plane mounted on its bottom surface. The frequency at which the microstrip antenna operates is approximately a half-wavelength in the microstrip medium of dielectric below the copper patch and air above the copper patch.

Generally, microstrip antennas used by weapons system to receive data have required considerable space on board the weapons system. To reduce the physical size of the microstrip antenna, prior art antenna designs have incorporated dielectrics with high dielectric constants. Since the wavelength for the antenna is approximately inversely proportionate to the dielectric constant, the size of the antenna is reduced for an increase in the dielectric constant. Unfortunately, there is a reduction in the bandwidth of the antenna with an increase in the dielectric constant. Further, there is a cost element associated with an increase in dielectric constant in that the dielectric material is more expensive.

SUMMARY OF THE INVENTION

The present invention overcomes some of the difficulties of the past in that comprises a highly effective microstrip antenna for receiving GPS data which requires considerably less space than other GPS microstrip antennas designed for use in confined spaces within a weapons system such as a missile, a smart bomb or the like.

The GPS microstrip antenna comprising the present invention receives GPS data from an external source such as a satellite and is adapted for use on weapons systems such as a missile. The microstrip antenna operates at the GPS L1 band and is centered at a frequency 1.575 GHz with a bandwidth of ±10 MHz. The microstrip antenna is square and has angled notches or slots in opposed corners which results in a circularly polarized microstrip antenna.

To reduce the size of the antenna an annular slot is positioned at the center of the antenna. The annular slot has a diameter of 0.3750 inches resulting in a 2% reduction in the size of the antenna which is there is limited space for placement of the antenna within the weapons system.

DETAILED DESCRIPTION OF A PREFERRED EMBODIMENT OF THE INVENTION

Figure 1:
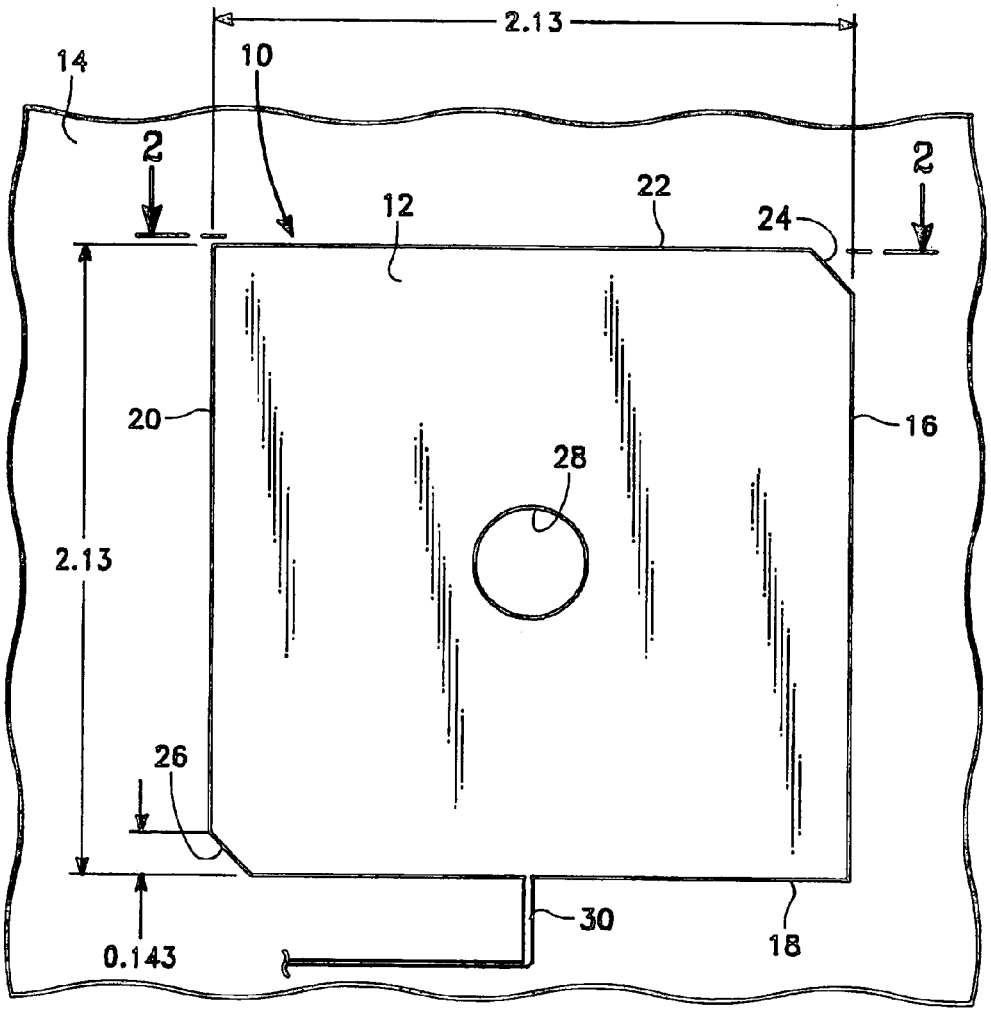
FIG. 1 is a plan view of a preferred embodiment of the present invention which comprises a microstrip antenna for use on a weapons system to receive GPS data from an external source.
Figure 2:
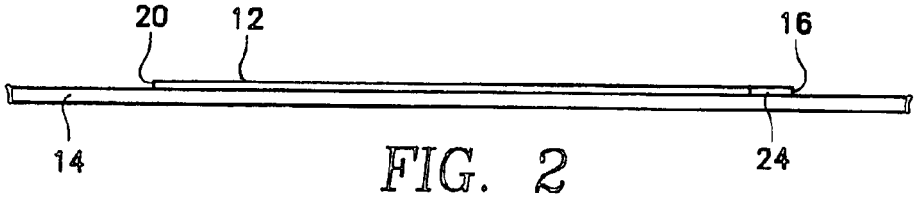
FIG. 2 is a side view of the microstrip antenna of FIG. 1.

Referring to FIGS. 1 and 2, there is shown a microstrip antenna 10 which functions as a GPS receiving antenna and is adapted for use on a small diameter projectiles such as a missile. Microstrip antenna 10 operates at the GPS L1 band and is centered at a frequency 1.575 GHz. The bandwidth for antenna 10 is ±10 MHz.

Microstrip antenna 10 includes a copper patch/antenna element 12 mounted on a dielectric substrate 14. Positioned below dielectric substrate 14 is a ground plan (not shown in FIG. 1). The dielectric substrate 14 used in the preferred embodiment of the present invention has a thickness of 0.050 inches and is fabricated from a laminate material RT/Duroid 6002 which is commercially available from Rogers Corporation of Rogers, Connecticut. The dielectric material selected for the microstrip antenna 10 provides sufficient strength and physical and electrical stability to satisfy environmental requirements and is also to mount on or within a missile.

Microstrip antenna 10 is circularly polarized which is achieved by an equal sided copper patch, i.e. copper antenna patch 12 has sides/edges 14, 16, 18 and 20 of equal length. The length of each edge 14, 16, 18 and 20 of antenna element 12 is 2.13 inches resulting in an antenna element which approximates a square. Dielectric substrate 14 is sized the same as antenna element 12 and also approximates a square.

Located in opposite corners of antenna element 12 are a pair of angled slots 24 and 26. Slot 26 extends inward from edge 18 and edge 20 0.1430 inches (as shown in FIG. 1). Slot 26 is angled at 45 degrees and has an overall length of 0.202 inches. In a like manner, slot 24 is angled at 45 degrees and has an overall length of 0.202 inches. As shown in FIGS. 1 and 2, dielectric substrate 14 extends beyond the antenna element 12.

Microstrip antenna 10 has a centrally locate aperture 28 or annular slot with a diameter of 0.3750 inches which extends through the antenna element 12 but not the dielectric substrate 14. Aperture 28 is positioned 1.0650 inches from the each edge 16, 18, 20 and 22 of antenna element 12 The positioning and the size of aperture 28 provide for a significant reduction in the size of microstrip antenna 14. Specifically, an antenna without aperture 28 has equal length sides of 2.172 inches with 0.156 inch by 0.156 inch notches. The addition of aperture 28 reduced the size of the microstrip antenna from 2.172 inches square to 2.130 inches square. This results in a 2% reduction in the size of the antenna 10 which is necessary because the space required for placement of the antenna is very limited and there is a requirement that the center frequency and the bandwidth remain the same as the center frequency and bandwidth for the previous antenna which did not include aperture 28.

The antenna element 12 for antenna 10 has a microstrip feed line 30 which connects antenna element 12 to data processing electronics on board the weapons system. Microstrip feed line 30 is a cooper feed line which has a characteristic impedance of 100 ohms.

From the foregoing, it is readily apparent that the present invention comprises a new, unique and exceedingly useful microstrip antenna with a slot for receiving GPS data which constitutes a considerable improvement over the known prior art. Many modifications and variations of the invention are possible in light of the above teachings. It is therefore to be understood that within the scope of the appended claims that the invention may be practiced otherwise than as specifically described.

What is claimed is:

1. A reduced size microstrip antenna for use on a projectile comprising:

a dielectric substrate positioned on said projectile;

an antenna element mounted on said dielectric substrate, said antenna element receiving a L-Band radio frequency signal from an external source, said antenna element having a shape approximating a square;

an annular slot centrally located within said antenna element, said annular slot being positioned and dimensioned to reduce a size for said antenna element by approximately two percent when compared to a solid copper antenna element operating at an identical frequency and bandwidth as said reduced size microstrip antenna; and a pair of angled slots located in opposed corner of said antenna element, said pair of angled slots providing for a circular polarization for said reduced size antenna element.

2. The microstrip antenna of claim 1 wherein said antenna element has four edges with equal lengths of 2.130 inches.

3. The microstrip antenna of claim 1 wherein said annular slot within said antenna element has a diameter of 0.3750 inches and is positioned 1.0650 inches from each of four edges of said antenna element.

4. The microstrip antenna of claim 1 wherein said pair of angled slots are angled at forty five degrees and have a length of 0.202 inches.

5. The microstrip antenna of claim 1 further comprising a copper transmission line connected to said antenna element, said copper transmission line being a signal output for said antenna element, said copper transmission line having a characteristic impedance of 100 ohms.

6. The microstrip antenna of claim 1 wherein said antenna element comprises a copper antenna element.

7. The microstrip antenna of claim 1 wherein said L-Band radio frequency signal is centered at a frequency 1.575 GHz with a bandwidth of ±10 MHz.

8. The microstrip antenna of claim 1 wherein said dielectric substrate has a thickness 0.050 inches and is fabricated from a laminate material.

9. The microstrip antenna of claim 1 wherein the antenna element of said microstrip antenna is adapted to receive GPS data contained within said L-Band radio frequency signal.

10. A reduced size microstrip antenna for use on a projectile comprising:

a dielectric substrate positioned on said projectile;

an antenna element mounted on said dielectric substrate, said antenna element receiving a L-Band radio frequency signal from an external source, said antenna element having a shape approximating a square and four edges, each of said four edges having a length of 2.130 inches;

an annular slot centrally located within said antenna element, said annular slot being positioned and dimensioned to reduce a size for said antenna element by approximately two percent when compared to a solid copper antenna element operating at an identical frequency and bandwidth as said reduced size microstrip antenna, said annular slot within said antenna element having a diameter of 0.3750 inches, said annular slot being positioned 1.0650 inches from each of the four edges of said antenna element; and a pair of angled slots located in opposed corner of said antenna element, said pair of angled slots providing for a circular polarization for said reduced size antenna element.

11. The microstrip antenna of claim 10 wherein said pair of angled slots are angled at forty five degrees and have a length of 0.202 inches.

12. The microstrip antenna of claim 10 further comprising a copper transmission line connected to said antenna element, said copper transmission line being a signal output for said antenna element, said copper transmission line having a characteristic impedance of 100 ohms.

13. The microstrip antenna of claim 10 wherein said antenna element comprises a copper antenna element.

14. The microstrip antenna of claim 10 wherein said L-Band radio frequency signal is centered at a frequency 1.575 GHz with a bandwidth of ±10 MHz.

15. The microstrip antenna of claim 10 wherein said dielectric substrate has a thickness 0.050 inches and is fabricated from a laminate material.

16. The microstrip antenna of claim 10 wherein the antenna element of said microstrip antenna is adapted to receive GPS data contained within said L-Band radio frequency signal.

17. A reduced size microstrip antenna for use on a projectile comprising:

a dielectric substrate positioned on said projectile;

an antenna element mounted on said dielectric substrate, said antenna element receiving a L-Band radio frequency signal from an external source, said antenna element having a shape approximating a square and four edges, each of said four edges having a length of 2.130 inches, said antenna element being fabricated from copper;

an annular slot centrally located within said antenna element, said annular slot being positioned and dimensioned to reduce a size for said antenna element by approximately two percent when compared to a solid copper antenna element operating at an identical frequency and bandwidth as said reduced size microstrip antenna, said annular slot within said antenna element having a diameter of 0.3750 inches, said annular slot being positioned 1.0650 inches from each of the four edges of said antenna element;

a pair of angled slots located in opposed corner of said antenna element, said pair of angled slots providing for a circular polarization for said reduced size antenna element, wherein said pair of angled slots are angled at forty five degrees and have a length of 0.202 inches; and a copper transmission line connected to said antenna element, said copper transmission line being a signal output for said antenna element, said copper transmission line having a characteristic impedance of 100 ohms.

18. The microstrip antenna of claim 17 wherein said L-Band radio frequency signal is centered at a frequency 1.575 GHz with a bandwidth of ±10 MHz.

19. The microstrip antenna of claim 17 wherein said dielectric substrate has a thickness 0.050 inches and is fabricated from a laminate material.

20. The microstrip antenna of claim 17 wherein the antenna element of said microstrip antenna is adapted to receive GPS data contained within said L-Band radio frequency signal.

* * * * *